US005088463A

United States Patent [19]

Affeldt et al.

[11] Patent Number: 5,088,463

[45] Date of Patent: Feb. 18, 1992

[54] FUEL SUPPLY SYSTEM FOR INTERNAL COMBUSTION ENGINES

[75] Inventors: Roger D. Affeldt, Ortonville; Alvin Powell, Corunna; Edward A. Urbanek, Jr., Southgate, all of Mich.

[73] Assignee: McGuane Industries, Auburn Hills, Mich.

[21] Appl. No.: 545,296

[22] Filed: Jun. 28, 1990

[51] Int. Cl.[5] ..... F02M 41/00

[52] U.S. Cl. ..... 123/459; 123/447; 123/456; 123/467; 123/514

[58] Field of Search ..... 123/456, 467, 468, 447, 123/179 L, 459, 514

[56] References Cited

U.S. PATENT DOCUMENTS

| | | | |
|---|---|---|---|
| 3,827,409 | 8/1974 | O'Neill | 123/456 |
| 4,205,637 | 6/1980 | Ito | 123/447 |
| 4,274,380 | 6/1981 | de Vulpillieres | 123/456 |
| 4,300,509 | 11/1981 | Schechter | 123/456 |
| 4,570,600 | 2/1986 | Atkins | 123/456 |
| 4,729,360 | 3/1988 | Fehrenbach | 123/467 |
| 4,756,289 | 7/1988 | Rock | 123/467 |
| 4,782,808 | 11/1988 | Bostick | 123/467 |
| 4,825,835 | 5/1989 | Deweerdt | 123/456 |

FOREIGN PATENT DOCUMENTS

| | | | |
|---|---|---|---|
| 0091363 | 5/1983 | Japan | 123/514 |

*Primary Examiner*—Carl Stuart Miller

*Attorney, Agent, or Firm*—Barnes, Kisselle, Raisch, Choate, Whittemore & Hulbert

[57] ABSTRACT

A fuel supply system for internal combustion engines wherein fuel is supplied to a fuel rail and, in turn, to fuel injectors which are electronically controlled to provide fuel to the cylinders of the engine including a fuel pressure regulator for controlling the pressure of fuel support to the fuel rail. A fuel bypass and damper device is provided upstream of the fuel pressure regulator and is operable to reduce the pressure of fluid in the fuel rail when the engine is shut off to provide a lower pressure in the fuel rail and bypass any excess fuel. The device further functions to dampen the noise when the engine is running. Such as system overcomes and fuel injection nozzles the problems of leakage of the injectors due to the high pressure retained in the system which in turn may produce long crank conditions, no start conditions, back fire conditions or high fuel emission conditions as well as engine noises.

12 Claims, 3 Drawing Sheets

FUEL SUPPLY SYSTEM FOR INTERNAL COMBUSTION ENGINES

This invention relates to fuel pressure systems and particularly to fuel systems for internal combustion engines having fuel injectors.

BACKGROUND AND SUMMARY OF THE INVENTION

In fuel injection systems of the port injection or throttle body type, fuel is supplied under pressure to electronically control fuel injectors which open and close to supply the fuel under pressure to the cylinders of the engine. It is common to provide a fuel pressure regulator downstream of the inlet to the fuel rail which functions upon application of fuel to cause a diaphragm assembly to move away form a valve seat to control the fuel flow from a fuel pump supply through the inlet and through the outlet of the regulator and to the tank. Pressure is maintained at the desired pressure differential between the pump and the outlet of the regulator. The fuel pump displaces a fixed flow rate so the amount of fuel returned to the tank varies with engine speed, the largest return rate occurring at idle. When the fuel pump is stopped the regulator starts to close then acts as a shut off valve to maintain pressure on the system. Fuel pressure regulators which can be used are such as shown in U.S. Pat. Nos. 3,511,270, 4,237,924 and 4,627,463.

It has been found that in such systems, when the engine is shut off, the system pressure may cause leakage pass the injector nozzles so that when the engine is restarted there may exist a long crank condition, a no start condition, a back fire condition and/or a high fuel emission condition. In addition there may be fuel noise when the engine is running due to the pressures know "hammer".

Among the objects of the present invention are to provide a fuel system which overcomes these problems.

In accordance with the invention, the fuel supply system for internal combustion engines wherein fuel is supplied to a fuel rail and, in turn, to fuel injectors which are electronically controlled to provide fuel to the cylinders of the engine including a fuel pressure regulator for controlling the pressure of fuel support to the fuel rail. A fuel bypass and damper device is provided upstream of the fuel pressure regulator and is operable to reduce the pressure of fluid in the fuel rail when the engine is shut off to provide a lower pressure in the fuel rail and fuel injector nozzles and bypass any excess fuel. The device further functions to dampen the noise when the engine is running. Such as system overcomes the problems of leakage of the injectors due to the high pressure retained in the system which in turn may produce long crank conditions, no start conditions, back fire conditions or high fuel emission conditions as well as engine noises.

DESCRIPTION

Figure 1:
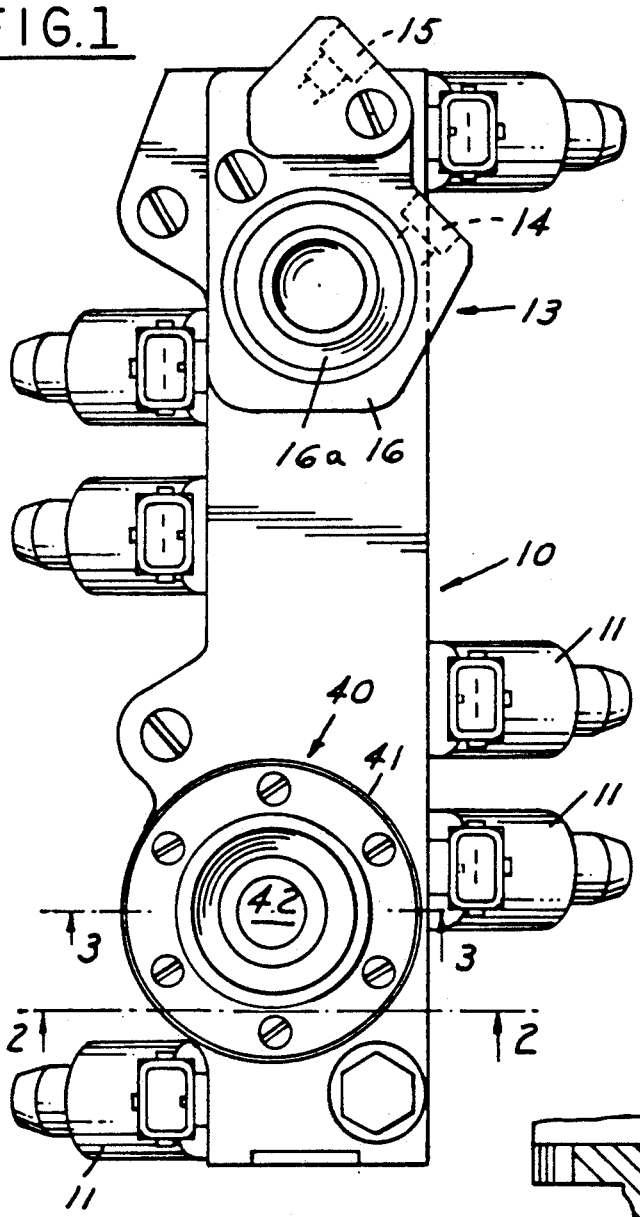
FIG. 1 is a fragmentary plan view of a fuel system embodying the invention.
Figure 2:
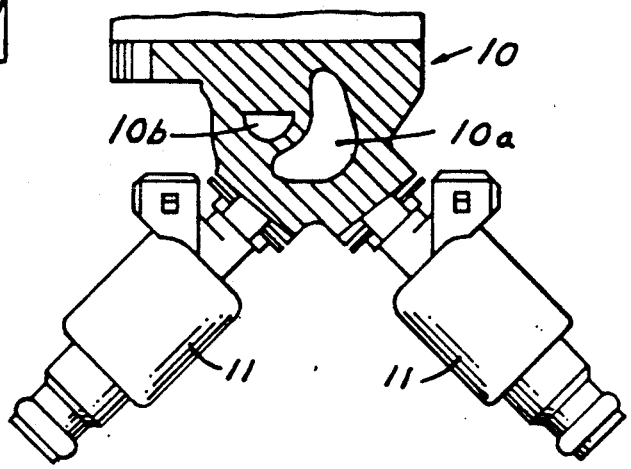
FIG. 2 is a fragmentary sectional view taken along the line 2—2 in FIG. 1.

Referring to FIG. 1, the fuel supply system embodying the invention comprises a fuel rail 10 of convention construction supporting a plurality of fuel injectors 11 that are electronically controlled to direct fuel from the fuel rail 10 to the cylinders of the engine. As shown in FIG. 2, the fuel rail 10 includes an inlet passage **10*a* and an outlet passage 10*b* extending longitudinally thereof with which the fuel injectors 11 communicate by passages extending to the fuel injectors 11**.

Figure 3:
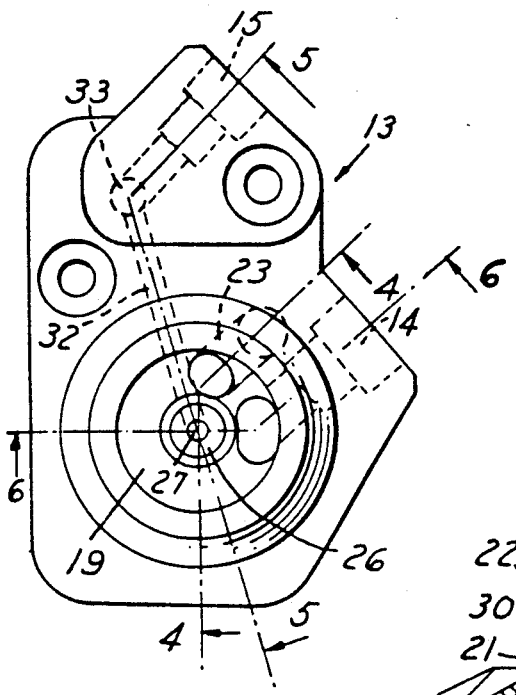
FIG. 3 is a plan view of a portion of the system shown in FIG. 1.
Figure 4:
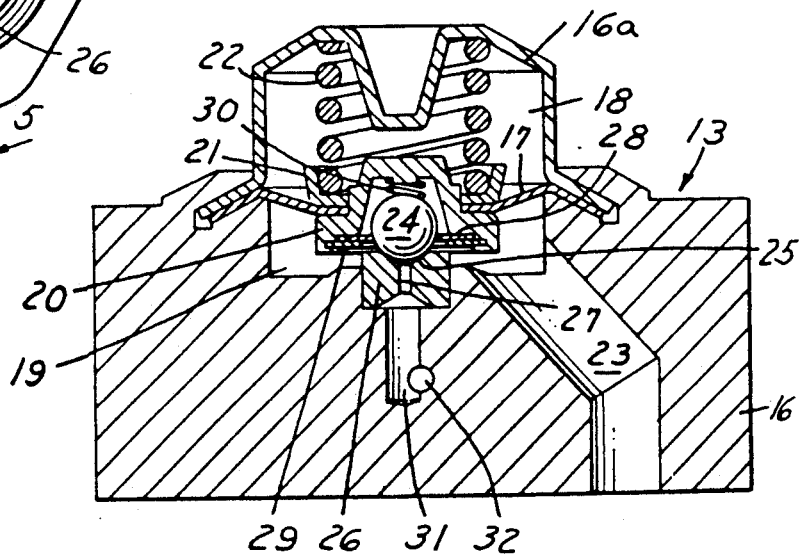
FIG. 4 is a sectional view taken along the line 4—4 in FIG. 1.
Figure 5:
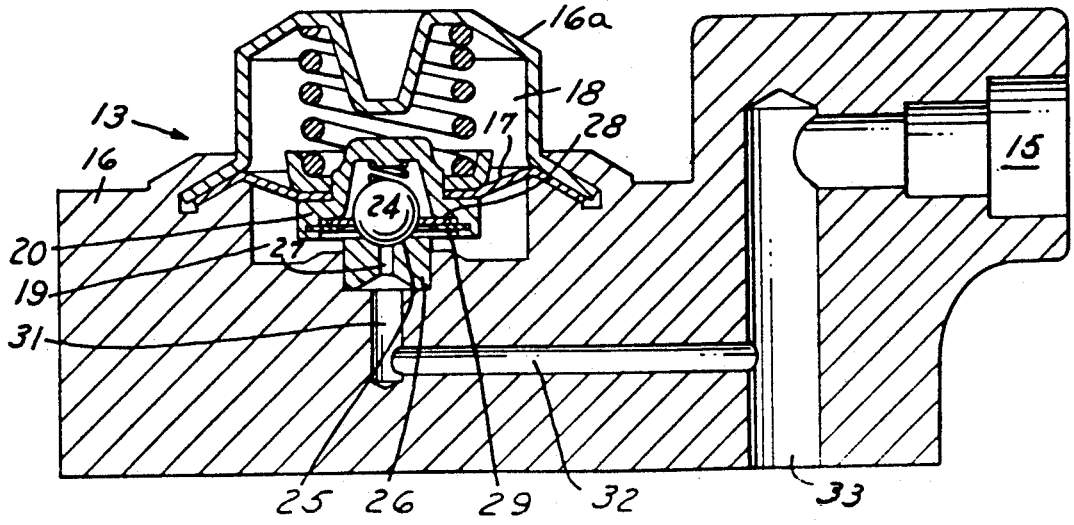
FIG. 5 is a sectional view taken along the line 5—5 in FIG. 3.

In accordance with the invention, a combined fuel bypass and damper device 13 is provided at one end of the fuel rail 10 and includes a fuel inlet 14 from a fuel pump and a fuel outlet 15 adapted to extend to a tank. The device 13 includes a body 16 and a cover **16*a* clamped to the body and supporting a diaphragm 17 therebetween. The diaphragm 17 divides the resultant housing into a first chamber 18 and a second chamber 19. The diaphragm may be made of two layers of elastic material such as fabric reinforced fluoro-silicone. The diaphragm 17 supports a cage 20 and the cage 20 is held in position by a spring retainer 21 that is connected to the cage 20 as by staking. A compression spring 22 urges the retainer 21 and the cage 20 downwardly as shown in FIG. 3 fuel entering through the inlet 14 passes through a passage 23 in the body 16 and an opening in the fuel rail 10 to the inlet passage 10*a* of the fuel rail 10. The cage 20 supports a ball 24 which is preferably made of elastomeric material and is yieldingly urged against a frustoconical seat 25 in an insert 26 having an orifice 27 therein. The ball 24 is supported by plates 28, 29. The plate 28 includes an opening having diameter less then the diameter of the ball 24 and a light spring 30 yieldingly urges the ball 24 downwardly in the opening in plate 28. The second plate 29 is retained in the lower end of the cage 21 by staking. The outer diameter of the first plate 28 is less then the outer diameter of the space in to which it fits so that the plate 18 can move laterally permitting movement of the ball 24 to accommodate misalignment between the ball 24 and valve seat 26**.

Figure 6:
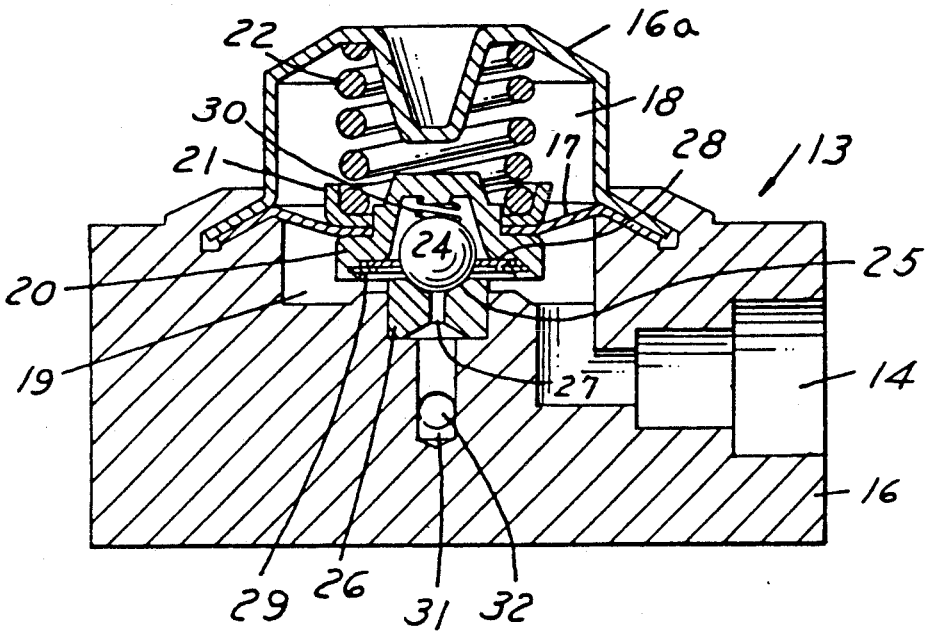
FIG. 6 is a sectional view taken along the line 6—6 in FIG. 4.
Figure 7:
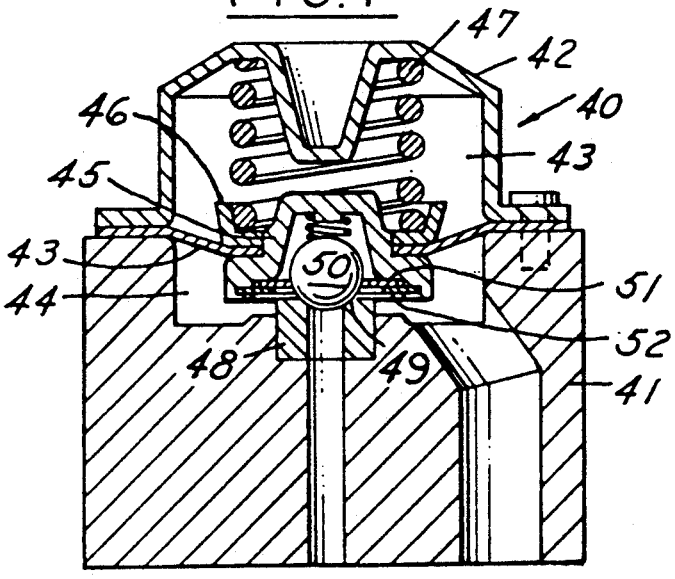
FIG. 7 is a fragmentary sectional view taken along the line 7—7 in FIG. 1

Referring to FIGS. 6 and 7 the normal pressure of fuel from the fuel pump is such that it exceeds the spring force of the spring 22 so that when the fuel is supplied, the diaphragm 17 is lifted permitting the ball 24 to open and permitting fuel to be metered through the orifice 27 and passages 31, 32, 33 to the outlet 14. Passage 33 also communicates through an opening in the fuel rail with the outlet passage **10*b* in the fuel rail 10**.

A fuel pressure regulator 40 is provided at the other end of the fuel rail 10 for controlling the pressure of fuel support to the fuel rail downstream of the combined fuel bypass and damper device 15.

The fuel pressure regulator 40 is preferably of the type shown in the U.S. Pat. No. 4,627,463, incorporated herein by reference. As shown in FIG. 3, the fuel pressure regulator 40 embodying the invention comprises a housing 41 consisting of and a cover 42 that are clamped together. A diaphragm 43 is provided between the housing 41 and cover 42 and may be made of two layers of elastic material such as fabric reinforced fluoro-silicone. The diaphragm 43 divides the housing into a first chamber 44 and a second chamber 44. The diaphragm 43 supports a cage 45 and the cage 45 is held in position by a spring retainer 46, that is connected to the cage 45 by staking. A compression spring 47 urges the retainer 45 and cage 46 downwardly as shown in FIG. 3. A fitting 48 extends into body 41 defines a frustoconical seat 49. The cage 45 supports a ball 50 which is retained in position by plates 51, 52. The plate 51 includes an opening having a diameter less than the diameter of the ball valve 50 and a light spring 53 yielding the urges the ball 50 downwardly in the opening into the plate 51. The second plate 52 is retained in the lower end of the cage 21 staking 32. The outer diameter of the first plate 51 is less than the outer diameter of the space into which it fits so that the plate 51 can move laterally permitting movement of the ball 50 to accommodate misalignment between the ball 50 and valve seat 49.

In operation, when the ignition of the vehicle is energized, the fuel pump forces fuel through the inlet 14 to the inlet of the fuel rail. The pressure of the fluid from the fuel pump is then directed to the fuel pressure regulator which functions to maintain a predetermined pressure along the inlet passage of the fuel rail. Inasmuch as the spring pressure on the diaphragm of the fuel pressure regulator is at a higher pressure then that of the fuel bypass and damper device, the diaphragm 17 of the damper device is lifted so that some fuel will be metered through the orifice 27 and will function to dampen the noises of the fuel which normally occur.

When the ignition is turned off, the fuel pump will stop functioning and the pressure of fuel in the fuel rail will immediately be lowered so that the fuel pressure regulator will close. Normally, the fuel in the fuel rail will be at a substantially high pressure. However, by use of the device 13, the diaphragm 17 will lift because of the lesser spring pressure of the spring 22 permitting the pressure in the fuel rail 10 to be lowered to a substantially lower value by passage to tank through the orifice 27 and passages 31, 32, 33 and outlet 15 at which time the ball will close.

As a result when the engine is stopped and not running, the lower pressure in the fuel rail will not cause leakage through the injectors. Since there is no leakage of fuel, when the engine is started again, the problems of long crank condition, no start condition, back fire condition are overcome. Finally, when the engine is running the dampening function of the device 13 operates to reduce fuel noise.

We claim:

1. A fuel bypass and damper device comprising a housing, a diaphragm dividing said housing into a first chamber and a second chamber, said housing having a fuel inlet into said second chamber, said body having a fuel outlet from said second chamber, said body having a valve seat associated with said outlet, a valve element, a spring yieldingly urging said valve element into engagement with said valve seat, and an orifice associated with said outlet downstream of said valve seat.

2. The fuel bypass and orifice device set forth in claim 1 wherein said valve element comprises a ball made of resilient elastomeric material.

3. In a fuel supply system for internal combustion engines wherein fuel is supplied to a fuel rail having an inlet passage and an outlet passage and in turn, to fuel injectors which are electronically controlled to provide fuel to the cylinders of the engine, the improvement comprising, a fuel bypass and damper device which is open when the engine is operating and which closes when the engine is shut off, said bypass device including an orifice downstream thereof such that when the engine is running a small portion of the fuel will be diverted, the pressure setting of said fuel bypass device being less than that of said fuel pressure regulator such that when the engine is shut off, the fuel in the inlet passage will open the bypass device permitting the pressure in the inlet passage of the fuel rail to be lowered to a substantially lower value by passage through the orifice until the pressure in the inlet passage of the fuel rail is reduced and the bypass and damper device closes communicating with said outlet passage of said fuel rail and operable to reduce the pressure of force in said inlet passage of said fuel rail when the engine is shut off to provide a lower pressure in the fuel rail and bypass any excess fuel, and a fuel pressure regulator communicating with said inlet passage and said outlet passage for controlling the pressure of fuel supplied to the inlet passage of the fuel rail, the pressure setting of said fuel bypass and damper device being less than that of said fuel pressure regulator such that when the engine is shut off, the fuel pressure in the inlet passage will open the bypass device permitting the pressure in the inlet passage of the fuel rail to be lowered to a substantially lower value by passage through the orifice until the pressure in the inlet passage of the fuel rail is reduced and the bypass device closes, said fuel bypass and damper device functioning to dampen fuel noises when said engine is operating.

4. The fuel system set forth in claim 3 wherein said fuel bypass device is positioned along the fuel rail upstream of the fuel pressure regulator and substantially all of the fuel injectors.

5. The fuel system set forth in any one of claims 3 or 4 wherein said fuel bypass and damper device comprises, a housing, a diaphragm dividing the housing into a first chamber and second chamber, a passage extending from the fuel rail to the second chamber, a passage extending from the second chamber to an outlet, said housing having a valve seat associated with the outlet, a valve element associated with said valve seat, a sprig yielding urging said valve element toward said valve seat, said orifice associated with said valve seat such that when the pressure in the second chamber increases, the valve element moves away from the valve seat permitting fuel passing from the inlet to the outlet passages and through the orifice.

6. The fuel supply system set forth in claim 5 wherein said valve element comprises a ball made of resilient elastomeric material.

7. The fuel system set forth in claim 5 wherein said orifice is positioned in a passage communicating with the outlet.

8. The fuel system set forth in claim 3 wherein said fuel bypass device has a fuel inlet for supplying fuel to said inlet passage of said fuel rail.

9. The fuel system set forth in claim 8 wherein said bypass device includes an outlet communicating with said outlet passage of said fuel rail.

10. The fuel system set forth in claim 9 wherein said fuel bypass device is positioned along the fuel rail upstream of the fuel pressure regulator and substantially all of the fuel injectors.

11. The fuel system set forth in claim 10 wherein said fuel bypass and damper device comprises, a housing, a diaphragm dividing the housing into a first chamber and second chamber, a passage extending from the fuel rail to the second chamber, a passage extending from the second chamber to an outlet, said housing having a valve seat associated with the outlet, a valve element associated with said valve seat, a spring yielding urging said valve element toward said valve seat, said orifice being associated with said valve seat such that when the pressure of the second chamber increases the valve element moves away from the valve seat fuel passing from the inlet to the outlet passes through the orifice.

12. The fuel system set forth in claim 11 wherein said valve element comprises a ball made of resilient elastomeric material.

* * * * *